US010618774B2

(12) United States Patent
Suoranta et al.

(10) Patent No.: US 10,618,774 B2
(45) Date of Patent: Apr. 14, 2020

(54) DISPLAYING VISIBLE OBJECTS FOR GUIDING TRAFFIC IN ELEVATOR ARRANGEMENT

(71) Applicant: KONE Corporation, Helsinki (FI)

(72) Inventors: Santeri Suoranta, Espoo (FI); Johannes de Jong, Järvenpää (FI); Visa Rauta, Hyvinkää (FI); Joonas Saaranen, Tampere (FI)

(73) Assignee: KONE CORPORATION, Helsinki (FI)

( * ) Notice: Subject to any disclaimer, the term of this patent is extended or adjusted under 35 U.S.C. 154(b) by 808 days.

(21) Appl. No.: 15/204,711

(22) Filed: Jul. 7, 2016

(65) Prior Publication Data

US 2016/0318733 A1 Nov. 3, 2016

Related U.S. Application Data

(63) Continuation of application No. PCT/FI2014/050128, filed on Feb. 20, 2014.

(51) Int. Cl.
*B66B 1/34* (2006.01)
*B66B 3/00* (2006.01)

(52) U.S. Cl.
CPC ..... *B66B 3/006* (2013.01); *B66B 3/002* (2013.01)

(58) Field of Classification Search
CPC ..... B66B 3/006; B66B 3/002
USPC ..... 187/247, 277, 380–388, 391, 392, 395, 187/396
See application file for complete search history.

(56) References Cited

U.S. PATENT DOCUMENTS 4,577,177 A 3/1986 Marubashi
4,623,869 A * 11/1986 Marubashi ..... B66B 3/00 187/391
4,708,224 A 11/1987 Schrooder
5,485,897 A 1/1996 Matsumoto et al.
(Continued)

FOREIGN PATENT DOCUMENTS

JP S64-64983 A 3/1989
JP H06-16350 A 1/1994
(Continued)

OTHER PUBLICATIONS

Supplementary European Search Report for European Application No. 14883297.5, dated Oct. 20, 2017.

*Primary Examiner* — Anthony J Salata
(74) *Attorney, Agent, or Firm* — Birch, Stewart, Kolasch & Birch, LLP.

(57) ABSTRACT

A method is provided for displaying information in an elevator arrangement including an elevator car that is movable, as controlled by an operating panel, between landing zones that communicate traffic to and from the elevator car through a doorway, and one or more light sources. In the method, visible objects are defined for guiding traffic of the elevator arrangement. A destination landing zone is obtained by the operating panel. A current occupancy and current destination landing zone of the elevator car are determined. The light sources are set to illuminate at least one of the defined visible objects on a remote surface on the basis of the determined current occupancy and current destination landing zone of the elevator car and the destination landing zone obtained by the operating panel.

19 Claims, 3 Drawing Sheets

Legend
802 - surface of the DIN
804, 814 - destination indicator (DIN)
806, 812 - light sources
810 - light

(56) References Cited

U.S. PATENT DOCUMENTS 5,679,934 A * 10/1997 Juntunen ..... B66B 1/462 187/384
6,065,570 A * 5/2000 Friedli ..... B66B 1/2458 187/387
6,076,638 A * 6/2000 Gertz ..... B66B 3/00 187/414
6,161,654 A * 12/2000 Sirigu ..... B66B 3/00 187/391
6,315,083 B1 * 11/2001 Schuster ..... B66B 1/463 187/380
6,986,408 B2 * 1/2006 Takeuchi ..... B66B 1/14 187/247
6,997,288 B2 * 2/2006 Kakko ..... B66B 3/023 187/391
7,338,176 B2 * 3/2008 Svensson-Hilford ..... B66B 13/24 187/396
7,712,586 B2 * 5/2010 Legez ..... B66B 1/20 187/387
7,793,761 B2 * 9/2010 Oberer ..... B66B 11/0233 187/391
8,003,907 B2 * 8/2011 Hoshino ..... B66B 3/00 200/308
8,096,388 B2 * 1/2012 Nakamura ..... B66B 3/006 187/391
8,136,636 B2 * 3/2012 Bahjat ..... B66B 1/463 187/391
8,151,942 B2 * 4/2012 Rusanen ..... B66B 1/468 187/247
8,496,091 B2 * 7/2013 Wu ..... B66B 3/00 187/391
8,744,754 B2 * 6/2014 Kappeler ..... B66B 1/468 187/391
9,463,955 B2 * 10/2016 Preston ..... B66B 1/468
9,505,586 B2 * 11/2016 Wu ..... B66B 5/0012
2006/0096811 A1 5/2006 Terry et al.
2008/0041669 A1 * 2/2008 Sansevero ..... B66B 3/00 187/389
2010/0217657 A1 8/2010 Gazdzinski
2010/0219025 A1 9/2010 Laihanen et al.
2010/0315603 A1 12/2010 Jeng

FOREIGN PATENT DOCUMENTS

JP H06-239550 A 8/1994
JP H11-130351 A 5/1999
JP 2006-256723 A 9/2006
WO WO 2012/164169 A1 12/2012

* cited by examiner

Legend

100 - elevator arrangement
102 - elevator car
104a-104d - landing zones
106a, 106b - light sources
108a, 108b, 114 -operating panel
110a, 110b - doorway
112 - shaft
200 - architecture
204 - memory
205 - controller
206a-206c - light sources
207 - elevator system
208 - operating panel
209 - drive unit
501 - passage
508 - destination floor
510 - doorway

Legend
602a, 602b - visible objects
610 - doorway
702 - radiating part
704a - 704c - discs
706 - axis
708 - visible object
710 - motor
712 - disc
714, 716 - visible objects Legend
100 - elevator arrangement

Legend
802 - surface of the DIN
804, 814 - destination indicator (DIN)
806, 812 - light sources
810 - light

DISPLAYING VISIBLE OBJECTS FOR GUIDING TRAFFIC IN ELEVATOR ARRANGEMENT

CROSS REFERENCE TO RELATED APPLICATIONS

This application is a Continuation of PCT International Application No. PCT/FI2014/050128, filed on Feb. 20, 2014, which is hereby expressly incorporated by reference into the present application.

FIELD

The present invention relates to displaying information in an elevator arrangement and more particularly to guiding traffic in the elevator arrangement.

BACKGROUND

Elevators are used in buildings to travel between different floors. A control panel of the elevator is typically located in elevator lobbies at each floor. A person wanting to use the elevator to travel from one floor to another presses a call button on the control panel and starts to wait for the elevator car to arrive at his floor. A display is provided in the lobbies to show the direction of movement of the elevator car. The displays are typically mounted to a wall near the elevator door. A person's view to a display may be impaired due to a large crowd of people or an architectural structure between him/her and the display. The amount of information displayed on the display is constrained by the viewable area of the display. Also viewing angle of the display may be restricted. Accordingly, in order to enable the elevator information to be viewed in the elevator lobby, even in crowded situations, display properties and installations locations should be optimized together, which is a complex task. Particularly in buildings that have architectural value, changes to the structures such as installation of elevators including displays at lobbies limited if allowed at all.

Moreover, moving the display in the lobby to a new location requires manual work and possibly renovation work to cover up the old installation space on the wall. On the other hand also renewing the old display, e.g. a digital display, with a new one, e.g. a Liquid Crystal Display, might cause renovation work due the new display needing a different size of installation space than the old one. In architecturally valuable buildings, installation of new displays and re-installation of the displays to new locations may require an authorisation which may cause delay and costs, and even prevent any modernization of elevators.

BRIEF DESCRIPTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

An object of the present invention is to provide a method, elevator arrangement, a destination indicator and a computer program product for implementing the methods so as to alleviate at least part of the above problems. The objects of the invention are achieved by method, elevator arrangement, a destination indicator and computer program product which are characterized by what is stated in the independent claims. The preferred embodiments of the invention are disclosed in the dependent claims.

According to an aspect there is provided a method of displaying information in an elevator arrangement comprising an elevator car movable, as controlled by an operating panel, between landing zones that communicate traffic to and from the elevator car through a doorway, and one or more light sources, the method comprising defining visible objects for guiding traffic of the elevator arrangement, obtaining a destination landing zone by the operating panel, determining a current occupancy and current destination landing zone of the elevator car, and setting the light sources to illuminate at least one of the defined visible objects on the basis of the determined current occupancy and current destination landing zone of the elevator car and the destination landing zone obtained by the operating panel.

According to an aspect there is provided an elevator arrangement comprising an elevator car movable, as controlled by an operating panel, between landing zones that communicate traffic to and from the elevator car through a doorway, and one or more light sources, and a controller operatively connected to the operating panel and the light sources and configured to cause the elevator arrangement to define visible objects for guiding traffic of the elevator arrangement, obtain a destination landing zone by the operating panel, determine a current occupancy and destination of the elevator car, and set the light sources to illuminate at least one of the defined visible objects on the basis of the determined current occupancy and destination of the elevator car and the destination landing zone obtained from the operating panel.

According to an aspect the is provided a destination indicator for an elevator arrangement comprising an elevator car movable, as controlled by an operating panel, between landing zones that communicate traffic to and from the elevator car through a doorway, said destination indicator comprising one or more displays for displaying a destination landing zone, wherein one or more light sources are installed behind the displays and directed away from the displays such that light may be emitted from the light source to a remote surface in the elevator arrangement, and a controller operatively connected to the operating panel and the light sources and configured to cause the elevator arrangement to define visible objects for guiding traffic of the elevator arrangement, obtain a destination landing zone by the operating panel, determine a current occupancy and destination of the elevator car, and set the light sources to illuminate at least one of the defined visible objects on the basis of the determined current occupancy and destination of the elevator car and the destination landing zone obtained from the operating panel.

According to an aspect there is provided an elevator arrangement comprising a destination indicator according to as aspect.

According to an aspect there is provided a computer program embodied on a non-transitory computer readable storage medium, the computer program being configured to control a processor to perform a method according to an aspect.

According to an aspect there is provided an elevator arrangement according to any one of claim including means to perform a method according to an aspect.

According to an aspect there is provided a computer program product comprising executable code that when executed, cause execution of functions of a method according to an aspect.

Some embodiments provide improvements comprising guiding traffic in an elevator arrangement such that the guidance is easily adaptable to the installation location of the elevator arrangement.

Some embodiments provide improvements comprising guiding traffic in an elevator arrangement such that the guidance supports high efficiency in terms of served traffic in various traffic scenarios.

BRIEF DESCRIPTION OF THE DRAWINGS

In the following the invention will be described in greater detail by means of preferred embodiments with reference to the accompanying drawings, in which.

DETAILED DESCRIPTION

In various embodiments visible objects are illuminated. The illumination provides that the visible objects are displayed. The visibility may refer to the visual capability of humans, whereby a visible object is visible to the human eye. The illumination is achieved by the use of visible or invisible light, whereby the visible light is visible to the human eye and invisible is not detected by the human eye. The visible objects may be illuminated on a remote surface. The remote surface may refer to a surface that is remote from the source of visible or invisible light used to illuminate the visible object. The remote surface is separated by a distance from the light source. Displaying visible objects on a remote surface has an advantage that the light source and the displayed visible object are separated, whereby the light source may be installed to a location that prevents tampering of the light source and/or the remote surfaces, where the visible objects are displayed do not necessarily need to be adapted e.g. by installing a display device.

Figure 1:
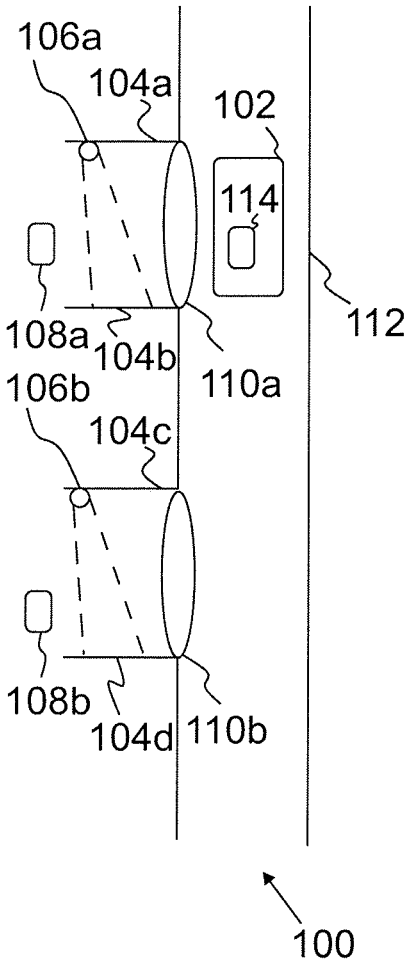
FIG. 1 illustrates an elevator arrangement according to an embodiment.

FIG. 1 illustrates an elevator arrangement 100 according to an embodiment. The elevator arrangement comprises an elevator car 102 movable, as controlled by an operating panel 108*a*, 108*b*, 114, between landing zones 104*a*, 104*b*, 104*c*, 104*d* that communicate traffic to and from the elevator car through a doorway 110*a*, 110*b*, and one or more light sources 106*a*, 106*b*. The light sources may be installed to a wall, floor 1044, 104*d* or ceiling 104*a*, 104*c* in the elevator arrangement. The light sources emit light that illuminate one or more visible objects on a remote surface. The remote surface may be a surface of the elevator arrangement or a building or other structure the elevator arrangement is installed. Since the light sources and the visible object are in remote locations, their locations may be chosen such that the light source may be installed to a location that prevents tampering of the light source and/or the remote surfaces, where the visible objects are displayed do not necessarily need to be adapted e.g. by installing a display device.

A landing zone may be located in one floor in a building where the elevator arrangement is installed. The landing zone refers to an area of the floor that communicates traffic with the elevator car through the doorway. The doorway may comprise a door such that the doorway may be closed, when the elevator car is not at the landing zone, but for example moving between the floors or stopped to another floor.

The elevator car moves between the landing zones in a shaft 112 that forms a passageway for the elevator car. A single shaft may have more than one, e.g. two or three elevator cars that each have their own passageways. The passageway may be referred to as a hoistway, when the elevator car is hoisted in the passage. Typically the hoisting is performed by one or more ropes that are connect hoisting machinery to the elevator car.

An operating panel may be located inside an elevator car, i.e. the operating panel is a Car Operator Panel (COP), or the operating panel may be located at the landing zone, i.e. the operating panel is a Destination Operator Panel (DOP). The DOP and COP may be may be installed to a wall as is conventional. For DOP, also a free-standing installation on the floor of the landing zone is possible.

The operating panel may include a user interface, for example one or buttons, a touch screen and/or a display. The operating panel provides a user to enter a destination landing zone to the elevator arrangement. The elevator car may be driven between the floors on the basis of the destination landing zone received via the operating panel. The elevator arrangement may comprise more than one operating panels that each may be used to enter a destination landing zone. The landing zone may have an operating panel installed to a wall. A typical operating panel in the landing zone is a button for indicating a destination landing zone that is higher or lower than the landing zone of the operating panel. The elevator car may also have an operating panel. Both operating panels in the landing zone and the in the elevator car may be cable of receiving a specific destination landing zone, e.g. defined by a number of the floor the landing zone is located in. The operating panel may also stand free on the floor of the landing zone.

Figure 2:
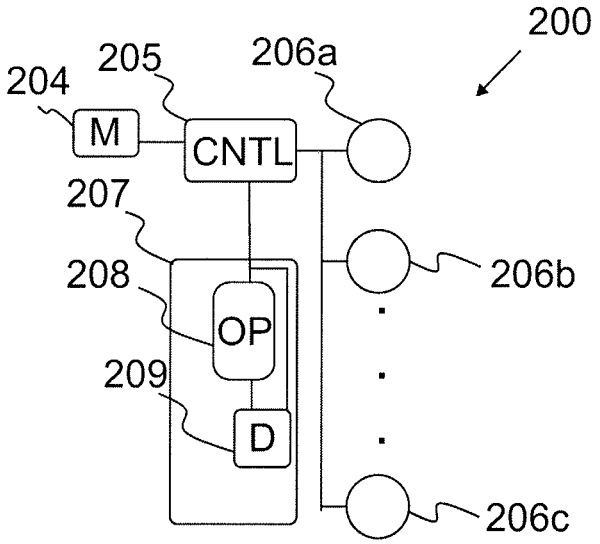
FIG. 2 illustrate architecture of an elevator arrangement according to an embodiment.

FIG. 2 illustrate architecture 200 of an elevator arrangement according to an embodiment. The elevator arrangement may be the elevator arrangement FIG. 1. The elevator arrangement comprises light sources 206*a*, 206*b*, 206*c*, a controller 205, a memory 204 and an elevator system 207. The controller is connected to the light sources for setting the light sources to illuminate visible objects, and to the elevator system for obtaining information to be used in determining how the light sources are set.

The elevator system may comprise one or more operating panels 208 for receiving selections of destination landing zones from users.

The elevator system may comprise a drive unit 209 for driving the elevator car between landing zones. The drive unit may be connected to the operating panel to obtain selections of destination landing zones from users for determining one or more current destination landing zones for the elevator car. The drive unit may control a hoisting machinery to drive the elevator car to one or more destination landing zones, and determine a current occupancy of the elevator car. The elevator car may be driven empty to pick up people from a landing zone or the elevator car may be occupied by one or more people. Accordingly, the occupancy of the elevator car may vary between an empty elevator car, where the elevator car has a minimum traffic load, and an elevator car occupied by a maximum traffic load of the elevator car. The traffic load may be determined in terms of weight, a number of people and occupied space in the elevator car. The drive unit may include or be connected to one or more of a scale, a 3D-camera an accelerometer that each may be arranged for measuring the traffic load within the elevator car. Typically the traffic is people, whereby the drive unit may determine the traffic load e.g. as a number of people within the elevator car. In determining the traffic load by weight of the traffic load on board the elevator car, either measured or statistical weight information may be used to determine the traffic load. Further ways to determine the load of the elevator car may be referred to in the current elevators on the market and need not to be discussed herein any further. The drive unit and the operating panel may provide information indicating one or more destination landing zones to the controller. In conventional elevator arrangements the information indicating the landing zones may be provided to a display in the landing zone of the elevator for indicating a destination landing zone(s) and or a direction of the elevator car to the people on the landing zone. The display may be referred to as a Destination Indicator (DIN).

The connections between the elevator system, light sources and the controller may be wired or wireless. A wired connection may be provided by an Ethernet connection. A wireless connection may be provided by an IEEE 802.11 based Wireless Local Area Network (WLAN) connection. Also wireless adapters and modem chips capable of communicating according to a mobile communications standard, for example Global System for Mobile Communications (GSM), Universal Mobile Telecommunications System (UMTS), Long Term Evolution and LTE-Advanced, all defined by the 3$^{rd}$ Generation Partnership Project (3GPP).

The controller may be implemented by a central processing unit (CPU). The CPU may comprise a set of registers, an arithmetic logic unit, and a control unit. The control unit is controlled by a sequence of program instructions transferred to the CPU from the memory. The control unit may contain a number of microinstructions for basic operations. The implementation of microinstructions may vary, depending on the CPU design. The program instructions may be coded by a programming language, which may be a high-level programming language, such as C, Java, etc., or a low-level programming language, such as a machine language, or an assembler. The memory may be a volatile or a non-volatile memory, for example EEPROM, ROM, PROM, RAM, DRAM, SRAM, firmware, programmable logic, etc. The memory and the controller may be connected by an electrical connection provided e.g. by a printed circuit board, where the memory and the controller are installed.

A light source may comprise a source of electromagnetic radiation that causes an object that receives the emitted radiation to illuminate a visible object. The visible object may be illuminated according to a definition of the visible object. The receiving object may be a surface of the elevator arrangement, e.g. a wall, a floor or a door. The electromagnetic radiation may comprise visible light or invisible light e.g. infrared radiation. Examples of the light sources comprise a light bulb, a Light Emitting Diode (LED), a fluorescent tube and an infrared radiator. When invisible light is used, the receiving object may be treated with paint or ink that is illuminated by the invisible light. The paint or ink may be fluorescent under infrared light, for example. The use of invisible light has the advantage that the light source is more difficult to discover, whereby the light source may be secured against tampering.

The memory may store definitions of visible objects for guiding traffic of the elevator arrangement. The visible objects may be formed by radiation emitted by one or more light sources as controlled by a definition of the visible object. The definition may comprise a graphical object, a number, a letter, a color of illumination and/or highlighting effect to be applied in illuminating a visible object. The graphical object may comprise a graphical object indicating available destinations at a destination landing zone or an arrow for guiding traffic to the direction of the arrow to load or unload the elevator car. One further example of the graphical object is a brand of a company located in the same floor as the destination landing zone. The number may comprise a number indicating a landing zone in the elevator arrangement. The color of illumination may be any color, for example red, blue, green or yellow. The highlighting effect may comprise blinking and or fading the illumination. The definition of the visible object may be used to illuminate the visible object such that traffic served by the elevator arrangement is guided. In one example the visible object is a part of the elevator arrangement, e.g. a wall, a door or a floor, or ceiling. Definitions may be combined to arrive in a visible object that is a combination of single visible object defined by the definitions.

In one example a light source may be implemented by a lamp having a disc placed in front of the light emitted by the lamp. The disc serves as a definition of the visible object, whereby the lamp and disc together effectively illuminate the visible object defined by the disc. The disc may include various definitions, e.g. numbers, graphical objects, colored transparent films and their combinations. Various discs may be arranged in series in front of the lamp, to illuminate a visible object that is a combination of a plurality of the definitions, i.e. discs. FIG. 7*a* describes a light source, e.g. a lamp, having discs in more detail.

Figure 3:
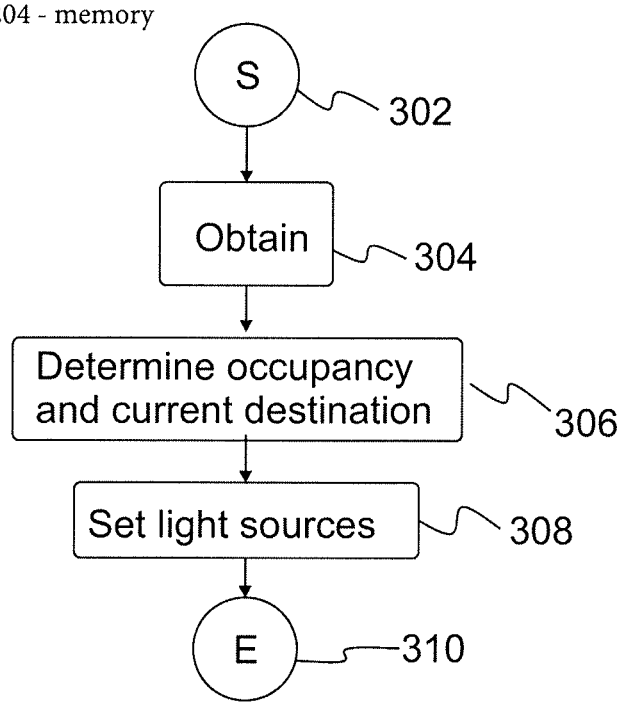
FIG. 3 illustrates a method of displaying information in an elevator arrangement according to an embodiment.

FIG. 3 illustrates a method of displaying information in an elevator arrangement according to an embodiment. The elevator arrangement may be the elevator arrangement illustrated in FIG. 1. The elevator arrangement may follow the architecture of FIG. 2.

The method starts 302 when the elevator arrangement is deployed and ready to serve traffic between landing zones. The elevator arrangement comprises one or more definitions visible objects for guiding traffic of the elevator arrangement. The elevator arrangement may be deployed by installing the elevator arrangement in a building and connecting the elevator arrangement to a power source.

In 304, a destination landing zone may be obtained by an operating panel of the elevator arrangement. The operating panel may be located in the landing zone or in the elevator car movable between landing zones.

In 306, a current occupancy and current destination landing zone of the elevator car are determined. The occupancy and current destination landing zone may be determined e.g. by a drive unit in an elevator system as described in FIG. 2.

In 308, one or more light sources are set to illuminate at least one of the defined visible objects on a remote surface on the basis of the determined current occupancy and current destination landing zone of the elevator car and the destination landing zone obtained by the operating panel. In this way, the guidance provided by the visible objects may be adapted to the traffic situation that may vary by the amount of total traffic served, by the amount of traffic travelling to a destination landing zone and by the number of destination landing zones. Accordingly, high efficiency in serving traffic by the elevator arrangement is facilitated.

The current occupancy and current destination landing zone may be used to determine a visible object that corresponds or at least indicates at least one destination landing zone of the traffic currently occupying the elevator car. The obtained destination landing zone may be used to determine a new visible object or modify the visible object determined on the basis of the current occupancy and current destination landing zone. In this way information about the destination landing zone may be illuminated to be viewable to the users of the elevator arrangement, while using information of the destination landing zone of the traffic already served by the elevator car and the destination landing zone obtained from traffic that may have only entered their destination landing zone e.g. on the landing zone or when entering the elevator car.

In an embodiment, one or more light sources are set to illuminate a visible object that indicates a direction of traffic into the elevator car and/or out of the elevator car. This embodiment is described in greater detailed in FIG. 5.

In one example, the visible object determined on the basis of the current occupancy and current destination landing zone is a number of a landing zone, e.g. '36'. The visible object determined on the basis of the obtained landing zone may comprise a different landing zone, e.g. '42'. Then the obtained destination landing zone '42' may be used to determine a new visible object or modify the visible object '36' such that the light sources are set to illuminate both destination floor numbers '36' and '42'. In this way the illuminated visible objects may be adapted on the basis of the information of the landing zone obtained from the operating panel and traffic offered to the elevator arrangement may be efficiently guided.

It should be appreciated that if the current destination floor number and the obtained destination floor number are the same, the light sources may be set to illuminate only one visible object that corresponds to the destination floor, e.g. '36'.

In 310, the method ends after at least one visible object for guiding the traffic has been illuminated.

Figure 4:
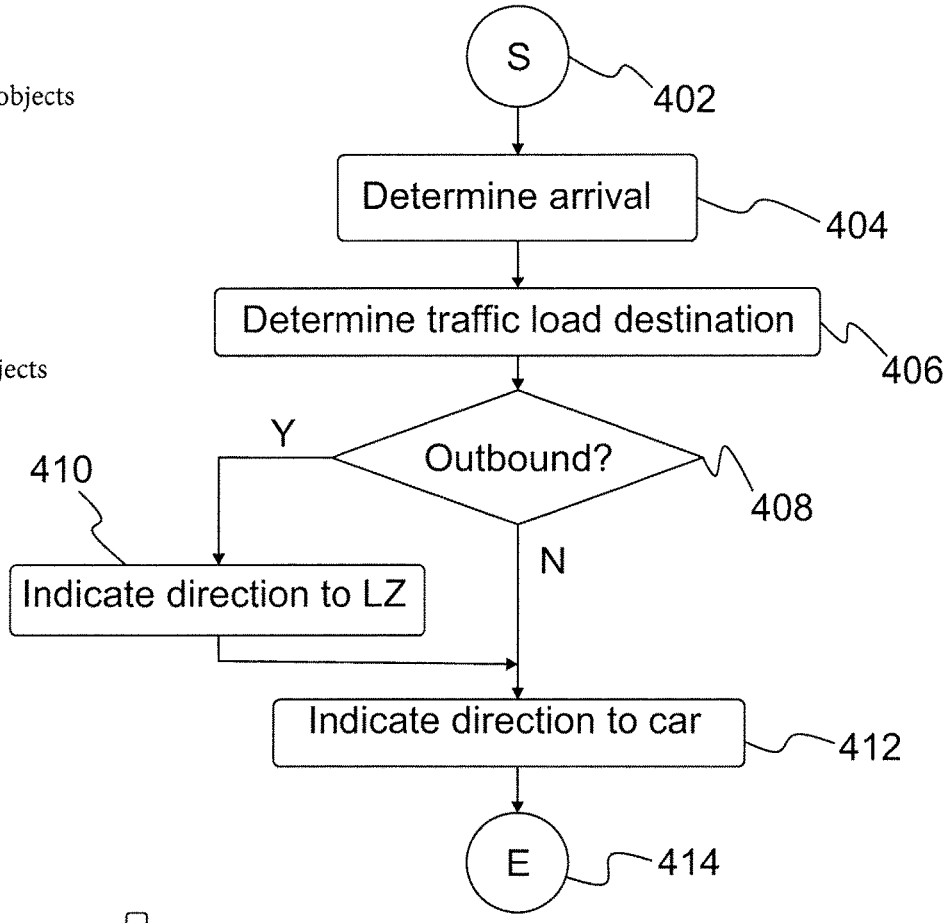
FIG. 4 illustrates a method of displaying information upon an arrival of the elevator car to a landing zone in an elevator arrangement according to an embodiment.

FIG. 4 illustrates a method of displaying information upon an arrival of the elevator car to a landing zone in an elevator arrangement according to an embodiment. The elevator arrangement may be the elevator arrangement illustrated in FIG. 1. The elevator arrangement may follow the architecture of FIG. 2.

The method starts 402 when the elevator arrangement is deployed and serving traffic between landing zones. Traffic is served by the elevator car moving between the landing zones and/or being stopped at a landing zone for boarding traffic into the elevator car. The elevator arrangement comprises one or more definitions visible objects for guiding traffic of the elevator arrangement. The elevator arrangement may be deployed by installing the elevator arrangement in a building and connecting the elevator arrangement to a power source.

In 404, an arrival of the elevator car to a landing zone is determined. An elevator system in the elevator arrangement may determine the arrival as part of controlling the driving of the elevator car.

In 406, it may be determined whether the elevator car has on board traffic for exiting at the determined arrival landing zone. The determining may comprise determining, whether the elevator car is occupied and determining a current destination landing zone of the elevator car. When the elevator car is occupied and the current destination landing zone of the elevator car corresponds to the arrival landing zone, it may be determined that there is on board traffic for exiting to arrival landing zone. The outbound on the arrival landing zone may be further confirmed by determining whether the arrival landing zone has been entered via an operating panel on board the elevator car. And if the arrival landing zone has been entered via the operating panel on board the elevator car, it may be determined that there is traffic that is leaving the elevator car at the arrival landing zone. It should be appreciated that the elevator car may have further destination landing zones than the arrival landing zone.

If 408 there is outbound traffic, the method continues to 410, where one or more light sources are set to illuminate at least one visible object indicating a traffic direction out of the elevator car. In this way the outbound traffic may be indicated to allow people on the landing zone to make room to allow traffic out of the elevator car and the stopping time due to outbound traffic may be kept small.

If 408 there is no outbound traffic, the method continues to 412, where one or more light sources are set to illuminate at least one visible object indicating a traffic direction into the elevator car. In this way the traffic that is to board the elevator car may be indicated to allow people on the landing zone to get ready to board the elevator car and the stopping time due to boarding the elevator car may be kept small.

After the light sources area set to illuminate at least one visible object indicating a traffic direction out of the elevator car, the light sources may be set to illuminate at least one visible object indicating a traffic direction into the elevator car. In this way the traffic that is to enter the elevator car has more room in the elevator car after the outbound traffic has left the car and the stopping time of the elevator car due to outbound traffic and boarding traffic may be kept small.

Preferably the light sources are set to illuminate the visible objects at arrival of the elevator car to the landing zone and before traffic can enter the elevator car or leave the elevator car. The flow of traffic may be prevented for example by the doorway which may be closed. Accordingly, the visible objects may be illuminated before opening the doors, e.g. 5 s before opening the doors such that the people on the landing zone and/or in the elevator car are allowed sufficient time to learn the guiding information. It is also possible that the guiding information provided by the visible objects is visible continuously, whereby the various embodiments described herein can be applied to update the visible objects that are illuminated.

The method ends 414 after one or more light sources are set upon arrival of the elevator car to the landing zone.

Figure 5:
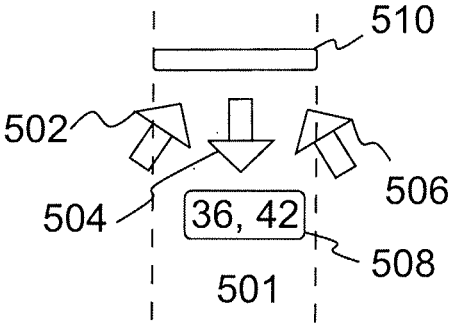
FIG. 5 illustrates visible objects for guiding traffic in an elevator arrangement according to an embodiment.

FIG. 5 illustrates visible objects for guiding traffic in an elevator arrangement according to an embodiment. The elevator arrangement may be the elevator arrangement according to FIG. 1. The elevator arrangement may follow the architecture of FIG. 2. The visible objects may be the visible objects illuminated in the steps 308, 410 and 412 of FIGS. 3 and 4. A visible object may be illuminated in front of a doorway 510 of the elevator arrangement. The visible objects may be illuminated to the landing zone floor. The visible objects comprise at least one of an arrow 504 indicating a direction of traffic out of the elevator car and a destination floor 508 positioned substantially in the middle of the landing zone in a passage 501 to the elevator car formed by the doorway and a part of the landing zone that is directly in front of the doorway, and one or more arrows 502, 506 indicating a direction of traffic into the elevator car positioned at sides of the passage. The various visible objects, e.g. those in FIG. 5, may be displayed at the same time or separately. Also a part of the visible objects may be displayed. Highlighting may be applied to indicate priority between the visible objects, when more than one object is displayed.

Figure 6A:
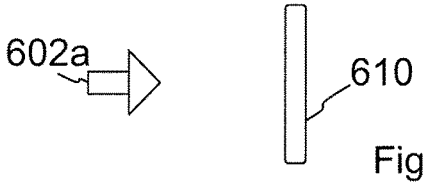
FIGS. 6*a*, 6*b* and 6*c* illustrate highlighting visible objects for guiding traffic according to an embodiment.
Figure 6B:
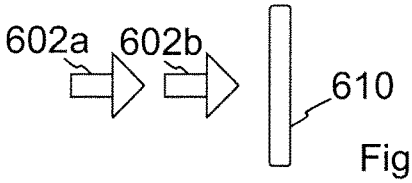
Figure 6C:
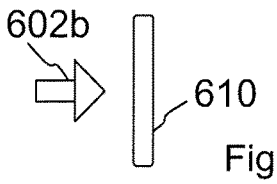

FIGS. 6*a*, 6*b* and 6*c* illustrate highlighting visible objects for guiding traffic according to an embodiment. The situation illustrated in FIGS. 6*a* to 6*c* may take place, when an elevator car is stopped to a landing zone. The highlighting may be performed in the methods of FIGS. 3 and 4 as part of the steps 308, 410 or 412. The highlighting enables improved visual perception for people, whereby guiding of people by the visible objects in various embodiments is improved. In FIGS. 6*a*, 6*b*, 6*c* one or more light sources are arranged to highlight the illuminated visible object by blinking. In FIGS. 6*a*, 6*b*, 6*c* the blinking is illustrated by setting on and off of the visible objects 602*a* and 602*b*. Here two visible objects are illuminated in front of a doorway 610 of the elevator arrangement. The visible objects may be illuminated on the floor of the elevator car or the landing zone for example. FIGS. 6*a*, 6*b* and 6*c* illustrate a sequence of time instants in the highlighting. The time sequence may start in FIG. 6*a*, proceed to FIG. 6*b* and end in FIG. 6*c*. The highlighting illustrated in FIGS. 6*a* to 6*c* may be repeated a plurality of times.

In FIG. 6*a* an arrow pointing towards the doorway is illuminated. The arrow may be located on the elevator landing zone and indicate a direction for traffic to enter the elevator car, for loading the elevator car. In FIG. 6*b* a second arrow that points towards the doorway is illuminated. The people are now presented twice the amount of information as in FIG. 6*a*, whereby the likelihood of the people perceiving the guiding provided by the arrows is increased. In FIG. 6*c*, the illumination of the first arrow 602*a* is set off and only the second arrow 602*b* remains visible. When arrows are illuminated repeatedly in a sequence of the FIGS. 6*a*, 6*b* and 6*c*, the user is further provided with a sense of progression of the illuminated visible objects regardless of their shape, whereby the guidance is further improved.

FIG. 7*a* illustrates a light source for illuminating a visible object, according to an embodiment. The light source comprises a radiating part 702 for emitting light and one or more discs 704*a*, 704*b*, 704*c* that each includes one or more definitions of visible objects. The radiated light is illustrated by a beam of light emitted in a direction of dashed lines in the FIG. 7. The discs are positioned to the emitted light such that a visible object 708 is illuminated to a remote surface, e.g. a wall, which receives the emitted light. In this way, the definition in the disc that is exposed to the emitted light is illuminated to the receiving surface. The light source includes a controller 712 that controls the position of the discs with respect to the emitted light and the light emitted by the radiating part. The radiating part may be controlled e.g. to emit a specific color of light and/or switching the light on and off. It should be appreciated that the color of light may be selected also by the disc. The disc may include a colored film, e.g. of plastic, to define the color of the visible object by the light travelling through the film to the receiving surface. A motor 710 is connected to the controller to rotate the shaft under control of the controller. The controller 712 may be the controller 205 and the radiating part 702 may be the light source 206*a*, 206*b*, 206*c* according to the architecture of FIG. 2.

The discs may be arranged rotatable such that rotation of the shaft changes the portion of the rotated discs that is exposed to the light from the radiating part. The discs that are rotated may be selectable. In this way only a part of the discs may be rotated and the position of the other discs may be maintained with respect to the light emitted from the radiating part. The rotation of the discs may be provided by an axis 706 formed e.g. by a rotatable shaft. The shaft may include gearing arranged on the circumference of the shaft. The discs may have gearing that match the gearing in the shaft such that rotation of the shaft is transformed into rotation of the discs. The shaft is movable in the direction of its length through the discs. The gearing on the shaft may be arranged only to a portion of the length of the shaft, whereby movement of the shaft in the direction of its length, forwards or backwards, may be used to position the gearing of the shaft to the gearing of the disc for rotating the disc. In this way the position of the shaft gearing with respect to the discs selects the disc that is rotated by the rotation of the shaft. A plurality of discs may be arranged in series on the path of the emitted light, whereby the visible object is defined by the combination of the portions of the discs that are exposed to the light. More than one light source may be directed in the same direction to illuminate a combination of separate visible objects. Electric motors and switches may be combined into machinery for moving he shaft under control of a controller.

It should be appreciated that a light source according to an embodiment may be a projector of digital video or images such that the projector projects video and images received from the controller through a lens system to the receiving surface. In this way, the discs described in FIG. 7*a* may be omitted and the illuminated visible objects may be defined more freely since no physical discs are needed. The controller may connect to the projector by an internal electrical connection over which the images or video to be projected may be conveyed to the radiating part for transformation into light.

Figure 7B:
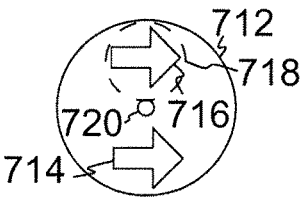
FIG. 7*b* illustrates an example of a disc exposable by light for illuminating visible objects.
Figure 7A:
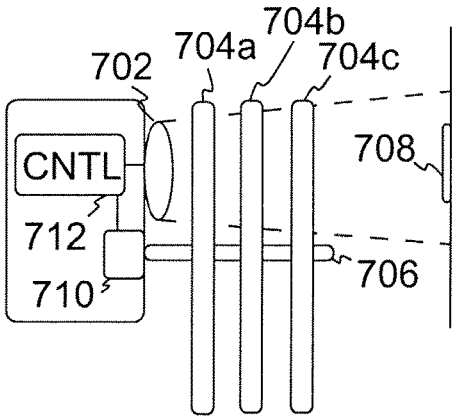
FIG. 7*a* illustrates a light source for illuminating a visible object, according to an embodiment.

FIG. 7*b* illustrates an example of a disc 712 exposable by light for illuminating visible objects. The disc may be used in the light source of FIG. 7*a*. The disc is viewed from its side towards the light, when installed to the light source. The disc includes definitions of visible objects 714, 716. The definitions may be holes in the shape of arrows. The holes may include a color film for applying a specific color to an object illuminated by using the definition. The disc is rotatable in at least one direction to change the arrow that is exposed to light. The portion of the disc exposed to the light is illustrated by an area defined by a dashed line 718. The disc may have a hole 720 in which a rotatable shaft may be positioned for rotating the disc.

Figure 8A:
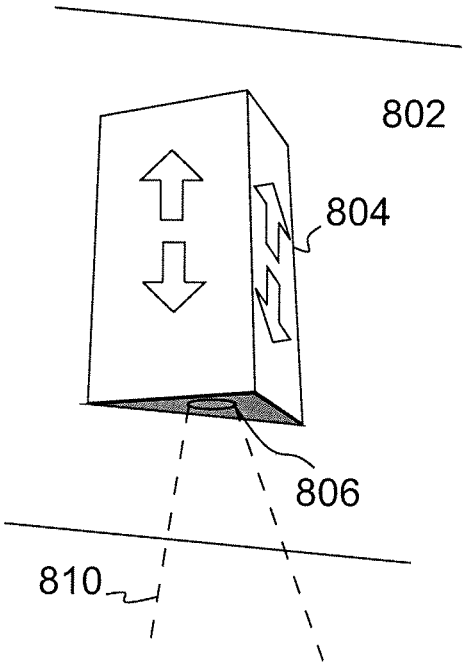
FIGS. 8*a* and 8*b* illustrate installation of light source to destination indicators in an elevator arrangement, according to embodiments.
Figure 8B:
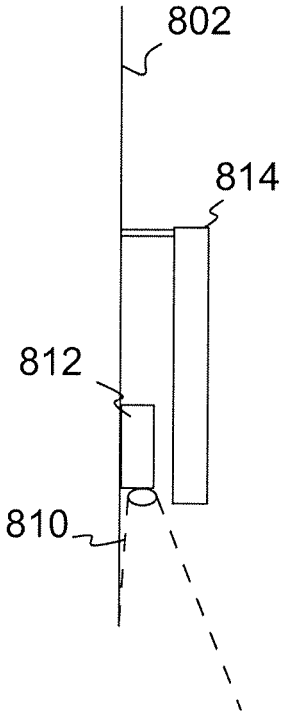

FIGS. 8*a* and 8*b* illustrate installation of light source 806, 812 to destination indicators 804, 814 in an elevator arrangement according to embodiments. The Destination Indicators (DINs) may be a part of an elevator arrangement of FIG. 1. The elevator arrangement may follow the architecture of FIG. 2. The destination indicator may display a destination floor and/or a direction of travel of the elevator car.

In FIG. 8*a*, the DIN 804 has two displays that are directed in different directions to display a destination landing zone viewable from a wide range of viewing angles. In FIG. 8*b*, the DIN has one display for displaying a destination landing zone.

In both embodiments of FIGS. 8*a* and 8*b* one or more light sources 806, 812 are installed behind the display and directed away from the display such that light 810 may be emitted from the light sources to a remote surface in the elevator arrangement for illuminating visible objects to the remote surface. In this way, guiding may be provided to traffic in the elevator arrangement by the DIN that is enhanced with the guiding provided by the light sources that illuminate a visible object to a remote surface in the elevator arrangement.

When the DIN is installed to the elevator arrangement, the light sources are positioned between the DIN and a surface 802 the DIN is attached to. The combination of the DIN and the light source provides resistance against tampering to the light source. Also, the combination ensures guiding of traffic in situations, where the illumination of visible objects to the remote surface may be challenging, e.g. in a strong sunlight. The DIN may have a higher illumination power than the light source whereby traffic guiding may be ensured under conditions of strong light. Since the display direction of the DIN and the direction of the light source are different, the traffic guiding information may be provided in several forms and directions, whereby guiding of traffic is improved especially when a crowd of people is guided and some people may be blocked by one another from viewing the DIN or the illuminated object.

The remote surface may be any surface in the elevator arrangement, for example wall, door or ceiling. Preferably the remote surface and the light source have a line of sight connection. In one example, the remote surface may be directly below or above, e.g. a floor or a ceiling, from the DIN. The DIN may be installed to a wall, a door, a ceiling or any other surface in the elevator arrangement.

Typically, the DINs are installed to the wall next to the elevator doorway in the landing zone. The DIN may be connected to the elevator system to receive information on destination landing zones and or direction of travel of the elevator car. One or more light sources may be installed behind the DIN in the elevator arrangement. The light sources maybe integrated with the DIN such that the DIN and the light sources may be sold and installed in one piece.

In an embodiment, a pre-installed DIN may be updated with a light source for illuminating visible objects according to an embodiment. The light source may be connected to existing connections of the DIN to an elevator system. In this way old elevator arrangements may be upgraded to arrive at an elevator arrangement according to an embodiment.

An embodiment provides a computer program embodied on a distribution medium, for example a non-transitory computer readable storage medium, comprising program instructions which, when loaded into an electronic apparatus, cause the controller to perform a method according to an embodiment.

The computer program may be in source code form, object code form, or in some intermediate form, and it may be stored in some sort of carrier, which may be any entity or device capable of carrying the program. Such carriers include a record medium, computer memory, read-only memory, electrical carrier signal, telecommunications signal, and software distribution package, for example. Depending on the processing power needed, the computer program may be executed in a single electronic digital computer or processor or it may be distributed amongst a number of computers or processors.

The techniques described herein may be implemented by various means so that an elevator arrangement implementing one or more functions described with an embodiment comprises not only prior art means, but also means for defining visible objects for guiding traffic of the elevator arrangement, obtaining a destination landing zone by the operating panel, determining a current occupancy and current destination landing zone of the elevator car, and setting the light sources to illuminate at least one of the defined visible objects on a remote surface on the basis of the determined current occupancy and current destination landing zone of the elevator car and the destination landing zone obtained by the operating panel.

An apparatus according to an embodiment may comprise a memory, a controller and one or more light sources that are electrically interconnected. The controller may be a processor, for example a single-core or a multi-core processor. The memory may be a volatile or a non-volatile memory, for example EEPROM, ROM, PROM, RAM, DRAM, SRAM, firmware, programmable logic, etc. The memory may store computer program instructions which, when executed by the processor cause the apparatus to functionality according to an embodiment. FIG. 2 and FIG. 7*a* illustrate examples of the apparatus.

More precisely, the various means comprise means for implementing functionality of a corresponding elevator arrangement described with an embodiment and it may comprise separate means for each separate function, or means may be configured to perform two or more functions. For example, these techniques may be implemented in hardware (one or more apparatuses), firmware (one or more apparatuses), software (one or more modules), or combinations thereof. For a firmware or software, implementation can be through modules (e.g., procedures, functions, and so on) that perform the functions described herein. The software codes may be stored in any suitable, processor/computer-readable data storage medium(s) or memory unit(s) or article(s) of manufacture and executed by one or more processors/computers. The data storage medium or the memory unit may be implemented within the processor/computer or external to the processor/computer, in which case it can be communicatively coupled to the processor/computer via various means as is known in the art.

It will be obvious to a person skilled in the art that, as the technology advances, the inventive concept can be implemented in various ways. The invention and its embodiments are not limited to the examples described above but may vary within the scope of the claims.

The invention claimed is:

1. A method of displaying information in an elevator arrangement comprising an elevator car movable, as controlled by an operating panel, between landing zones that communicate traffic to and from the elevator car through a doorway, and one or more light sources, the method comprising the steps of:

defining visible objects for guiding traffic of the elevator arrangement;

obtaining a destination landing zone by the operating panel;

determining a current occupancy and current destination landing zone of the elevator car; and setting the one or more light sources to illuminate at least one of the defined visible objects on a remote surface on the basis of the determined current occupancy and current destination landing zone of the elevator car and the destination landing zone obtained by the operating panel, wherein the remote surface refers to a surface that is remote from the one or more light sources used to illuminate the visible object, and wherein the one or more lights sources are arranged to highlight the illuminated at least one defined visible object by blinking and/or fading for highlighting a direction of movement of the traffic.

2. The method according to claim 1, further comprising the steps of:

determining an arrival of the elevator car to a respective landing zone;

determining whether the elevator car has on board traffic for exiting at the determined arrival landing zone; and setting the one or more light sources to illuminate at least one visible object indicating a traffic direction out of the elevator car, when there is on board traffic for exiting at the determined arrival landing zone.

3. The method according to claim 1, further comprising the step of:

setting the one or more light sources to illuminate at least one visible object indicating a traffic direction into the elevator car.

4. The method according to claim 1, further comprising the step of:

setting the one or more light sources to illuminate at least one visible object indicating a traffic direction into the elevator car after setting the one or more light sources to illuminate at least one visible object indicating a traffic direction out of the elevator car.

5. The method according to claim 1, wherein a plurality of lights are set such that the visible objects are illuminated in a sequence that progresses to a direction that indicates a traffic direction into the elevator car or out of the elevator car.

6. The method according to claim 1, wherein the one or more light sources are installed inside the elevator car or at the landing zone for displaying the visible objects on the walls, floor or a door of the elevator arrangement.

7. The method according to claim 1, wherein the visible objects comprise one or more or a combination of an arrow for guiding traffic to the direction of the arrow to load or unload the elevator car, a destination landing zone of the elevator car, a graphical representation indicating available destinations at a destination landing zone and a coloured part of the elevator arrangement.

8. The method according to claim 1, wherein a plurality of the visible objects are illuminated to the landing zone floor and the plurality of visible objects comprise at least one of an arrow indicating a direction of traffic out of the elevator car and a destination floor positioned substantially in the middle of the landing zone in a passage to the elevator car formed by the doorway and a part of the landing zone that is directly in front of the doorway, and one or more arrows indicating a direction of traffic into the elevator car positioned at sides of the passage.

9. The method according to claim 1, wherein the one or more light sources illuminate invisible light to the remote surface that is treated with fluorescent.

10. An elevator arrangement comprising:

an elevator car, the elevator car being movable, as controlled by an operating panel, between landing zones that communicate traffic to and from the elevator car through a doorway;

one or more light sources; and a controller operatively connected to the operating panel and the one or more light sources and configured to cause the elevator arrangement to:

define visible objects for guiding traffic of the elevator arrangement;

obtain a destination landing zone by the operating panel;

determine a current occupancy and destination of the elevator car; and set the one or more light sources to illuminate at least one of the defined visible objects on a remote surface on the basis of the determined current occupancy and destination of the elevator car and the destination landing zone obtained from the operating panel, wherein the remote surface refers to a surface that is remote from the one or more light sources used to illuminate the visible object, and wherein the one or more lights sources are arranged to highlight the illuminated at least one defined visible object by blinking and/or fading for highlighting a direction of movement of the traffic.

11. A destination indicator for an elevator arrangement, the elevator arrangement comprising an elevator car, the elevator car being movable, as controlled by an operating panel, between landing zones that communicate traffic to and from the elevator car through a doorway, said destination indicator comprising:

one or more displays for displaying a destination landing zone, wherein one or more light sources are installed behind the displays and directed away from the displays such that light may be emitted from the one or more light sources to a remote surface in the elevator arrangement; and a controller operatively connected to the operating panel and the one or more light sources and configured to cause the elevator arrangement to:

define visible objects for guiding traffic of the elevator arrangement;

obtain a destination landing zone by the operating panel;

determine a current occupancy and destination of the elevator car; and set the one or more light sources to illuminate at least one of the defined visible objects on the basis of the determined current occupancy and destination of the elevator car and the destination landing zone obtained from the operating panel, wherein the remote surface refers to a surface that is remote from the one or more light sources used to illuminate the visible object, and wherein the one or more lights sources are arranged to highlight the illuminated at least one defined visible object by blinking and/or fading for highlighting a direction of movement of the traffic.

12. An elevator arrangement comprising the destination indicator according to claim 11.

13. An elevator arrangement comprising:

an elevator car, the elevator car being movable, as controlled by an operating panel, between landing zones that communicate traffic to and from the elevator car through a doorway;

one or more light sources; and a controller operatively connected to the operating panel and the one or more light sources and configured to cause the elevator arrangement to:

define visible objects for guiding traffic of the elevator arrangement;

obtain a destination landing zone by the operating panel;

determine a current occupancy and destination of the elevator car; and set the one or more light sources to illuminate at least one of the defined visible objects on a remote surface on the basis of the determined current occupancy and destination of the elevator car and the destination landing zone obtained from the operating panel, wherein the remote surface refers to a surface that is remote from the one or more light sources used to illuminate the visible object, wherein the one or more lights sources are arranged to highlight the illuminated at least one defined visible object by blinking and/or fading for highlighting a direction of movement of the traffic, and wherein the controller is configured to cause the elevator arrangement to perform the steps of claim 2.

14. A computer program product embodied on a non-transitory computer readable medium and comprising executable code that when executed, cause execution of functions of the method according to claim 1.

15. The method according to claim 9, wherein the fluorescent is infrared fluorescent, paint or ink.

16. The method according to claim 2, further comprising the step of:

setting the one or more light sources to illuminate at least one visible object indicating a traffic direction into the elevator car.

17. The method according to claim 2, further comprising the step of:

setting the one or more light sources to illuminate at least one visible object indicating a traffic direction into the elevator car after setting the one or more light sources to illuminate at least one visible object indicating a traffic direction out of the elevator car.

18. The method according to claim 3, further comprising the step of:

setting the light sources to illuminate at least one visible object indicating a traffic direction into the elevator car after setting the one or more light sources to illuminate at least one visible object indicating a traffic direction out of the elevator car.

19. The method according to claim 2, wherein a plurality of lights are set such that the visible objects are illuminated in a sequence that progresses to a direction that indicates a traffic direction into the elevator car or out of the elevator car.

* * * * *